US008632416B2

(12) United States Patent
Finn et al.

(10) Patent No.: US 8,632,416 B2
(45) Date of Patent: Jan. 21, 2014

(54) GOLF CLUBS AND GOLF CLUB HEADS

(75) Inventors: Michael E. Finn, Fort Worth, TX (US); Raymond J. Sander, Benbrook, TX (US); Jeremy N. Snyder, Benbrook, TX (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 13/215,019

(22) Filed: Aug. 22, 2011

(65) Prior Publication Data

US 2012/0157224 A1 Jun. 21, 2012

Related U.S. Application Data

(60) Provisional application No. 61/375,593, filed on Aug. 20, 2010.

(51) Int. Cl.
*A63B 53/04* (2006.01)

(52) U.S. Cl.
USPC ..... 473/291

(58) Field of Classification Search
USPC ..... 473/291
See application file for complete search history.

(56) References Cited

U.S. PATENT DOCUMENTS

| | | | | |
|---|---|---|---|---|
| 4,645,207 | A | 2/1987 | Teramoto et al. | |
| 5,735,754 | A | 4/1998 | Antonious | |
| 5,800,281 | A | 9/1998 | Gilbert | |
| 6,183,376 | B1 | 2/2001 | Peters et al. | |
| 7,169,057 | B2 * | 1/2007 | Wood et al. | 473/290 |
| 2004/0121852 | A1 | 6/2004 | Tsurumaki | |
| 2004/0147335 | A1 | 7/2004 | Iwata et al. | |
| 2004/0192463 | A1 | 9/2004 | Tsurumaki et al. | |
| 2005/0037864 | A1 | 2/2005 | Gilbert et al. | |
| 2005/0085312 | A1 | 4/2005 | Nagai et al. | |

(Continued)

FOREIGN PATENT DOCUMENTS

| | | | |
|---|---|---|---|
| EP | 0517487 | A1 | 9/1992 |
| GB | 2288984 | A | 8/1995 |
| WO | 2006/014905 | | 2/2006 |

OTHER PUBLICATIONS

International Search Report and Written Opinion issued in corresponding International Application No. PCT/US2011/048674, mailed Dec. 6, 2011.

(Continued)

*Primary Examiner* — Michael Dennis
(74) *Attorney, Agent, or Firm* — Banner & Witcoff, Ltd.

(57) ABSTRACT

A set of golf clubs in accordance with at least some examples of this disclosure may include one or more of the golf clubs which include an iron-type golf club head with a 3-piece configuration which may include a ball striking face; a golf club head body including a rear surface opposite the ball striking face, which may include a perimeter weighting member extending in a direction rearward from the ball striking face and along at least a portion of a circumferential area of the golf club head body; and an insert engaged with the golf club head body and positioned behind the ball striking face of the golf club head. Further, one or more of the golf clubs in the set may include iron-type golf club heads with a 2-piece configuration which may include a golf club head body and an insert engaged with the golf club head body. Additionally, one or more of the golf clubs in the set may include iron-type golf club heads with a 1-piece configuration.

35 Claims, 6 Drawing Sheets

(56) References Cited

U.S. PATENT DOCUMENTS

| | | | | |
|---|---|---|---|---|
| 2005/0239572 | A1* | 10/2005 | Roach et al. | 473/332 |
| 2009/0118037 | A1 | 5/2009 | Roach et al. | |
| 2009/0124410 | A1 | 5/2009 | Rife | |

OTHER PUBLICATIONS

International Search Report, dated May 10, 2012, from PCT/US2011/048656.

* cited by examiner

GOLF CLUBS AND GOLF CLUB HEADS

CROSS-REFERENCE TO RELATED APPLICATIONS

This application is a non-provisional application which claims priority to U.S. Provisional Application Ser. No. 61/375,593, filed Aug. 20, 2010, the disclosure of which is hereby incorporated by reference in its entirety.

FIELD OF THE DISCLOSURE

The present disclosure relates to golf clubs and golf club heads. Particular example aspects of this disclosure relate to a set of golf clubs with different types of golf club heads.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

While the industry has witnessed dramatic changes and improvements to golf equipment in recent years, there is room in the art for further advances in golf club technology.

SUMMARY OF THE DISCLOSURE

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Golf club heads according to at least some example aspects of this disclosure include: (a) a ball striking face; (b) a golf club head body including a rear surface opposite the ball striking face, which may include a perimeter weighting member extending in a direction rearward from the ball striking face and along at least a portion of a circumferential area of the golf club head body; and (c) an insert engaged with the golf club head body and positioned behind the ball striking face of the golf club head.

Further, golf club heads according to at least some example aspects of this disclosure include: (a) an iron-type golf club head body including a ball striking face and a rear surface opposite the ball striking face, wherein the rear surface may include a perimeter weighting member extending rearward from the ball striking face and along at least a portion of a circumferential area of the golf club head body and (b) an insert engaged with the golf club head body and positioned behind the ball striking face of the golf club head.

Golf club heads according to at least some example aspects of this disclosure include: (a) an iron-type golf club head body which includes a ball striking face, a rear surface opposite the ball striking face, which may include a perimeter weighting member extending rearward from the ball striking face and along at least a portion of the circumferential area of the golf club head.

A set of golf clubs in accordance with at least some examples of this disclosure may include one, some or all of the above described golf club heads. For example, one or more of the golf clubs in the set may include iron-type golf club heads with the 3-piece configuration which will be described in detail below. Further, one or more of the golf clubs in the set may include iron-type golf club heads with the 2-piece configuration which will be described in detail below. Additionally, one or more of the golf clubs in the set may include iron-type golf club heads of the 1 piece configuration which will be described in detail below.

Additional aspects of this disclosure relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; additional weight members; etc.

Still additional aspects of this disclosure relate to methods for producing golf club heads and golf club structures, e.g., of the types described above. Such methods may include, for example: (a) providing a golf club head of the various types described above, e.g., by manufacturing or otherwise constructing the golf club head body, by obtaining the golf club head body from another source, etc.; and (b) engaging a shaft member with the golf club head. Other steps also may be included in these methods, such as engaging a grip member with the shaft member, club head body finishing steps, etc.

BRIEF DESCRIPTION OF THE DRAWINGS

The present disclosure is illustrated by way of example and not limited in the accompanying figures, in which like reference numerals indicate similar elements throughout, and in which.

Figure 1:
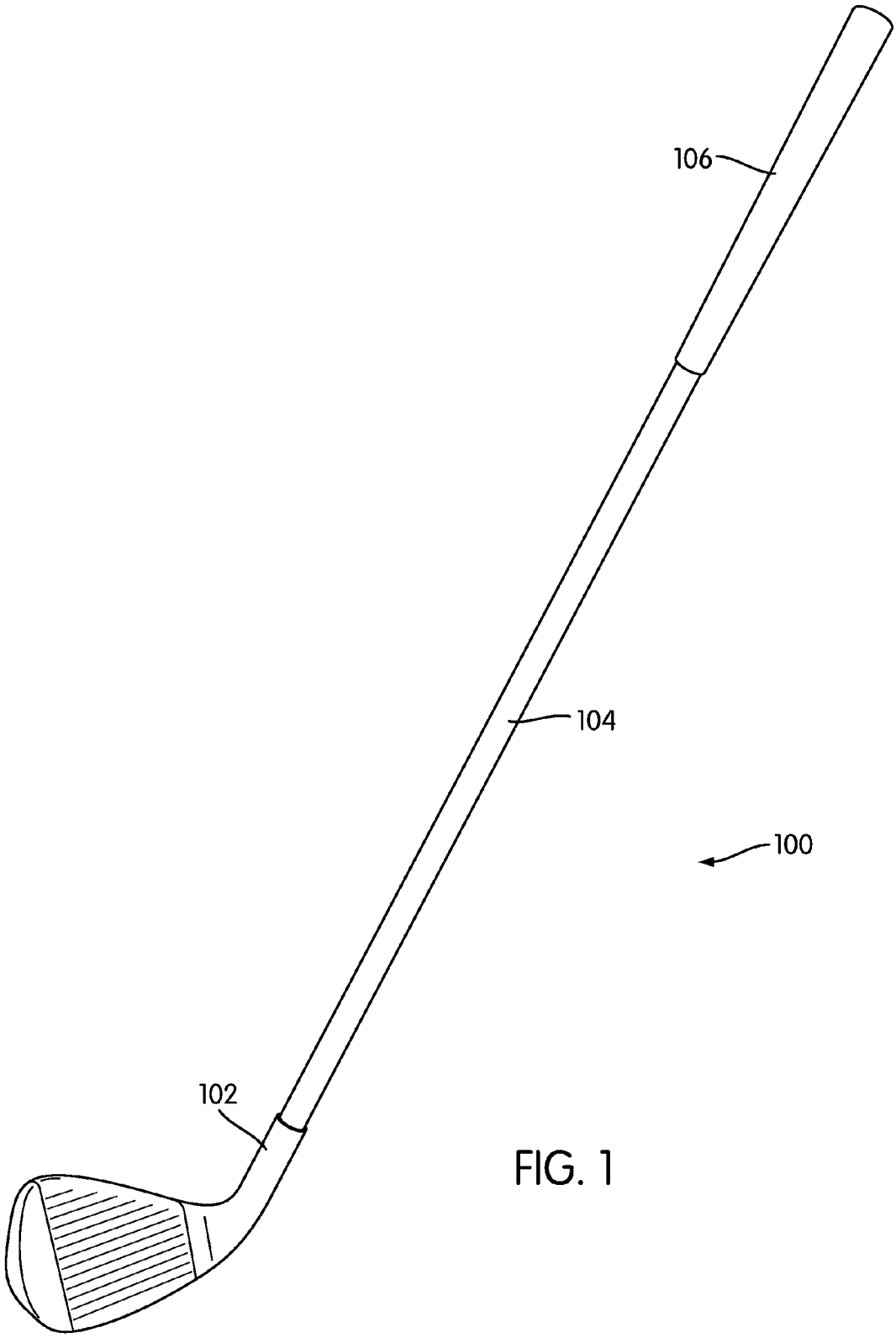
FIG. 1 generally illustrates features of a golf club structure according to at least some examples of this disclosure.

The reader is advised that the various parts shown in these drawings are not necessarily drawn to scale.

DETAILED DESCRIPTION

The following description and the accompanying figures disclose features of golf club heads and golf clubs in accordance with examples of the present disclosure.

I. General description of example golf club heads, golf clubs, and Methods in accordance with this disclosure As described above, aspects of this disclosure relate to iron-type golf club heads and golf clubs. Iron-type golf club heads according to at least some example aspects of this disclosure may include: (a) a ball striking face; (b) a golf club head body including a rear surface opposite the ball striking face, which may include a perimeter weighting member extending in a direction rearward from the ball striking face and along at least a portion of a circumferential area of the golf club head body; and (c) an insert engaged with the golf club head body and positioned behind the ball striking face of the golf club head.

According to some aspects of this disclosure, "long" iron-type golf clubs (i.e., irons with a relatively low degree of loft, e.g., a 3-iron, a 4-iron) of the set of golf clubs according to aspects of the disclosure may be configured with the above mentioned 3 piece configuration which will be described in detail below. As will be described in detail below, the configuration of such 3-piece irons may provide a center of gravity of the golf club head which is low in the golf club head and away from the ball striking face of the golf club head. Such a configuration may aid a golfer in imparting a more lofted trajectory to the golf ball (e.g., getting the ball in the air). Therefore, providing the center of gravity of the golf club head lower and towards the rear of the golf club head may be particularly advantageous for hitting "long" irons.

Further, as will be described in detail below, the 3 piece configuration described above may provide a center of gravity of the golf club head which is more centered, relative to the center of the face of the golf club head. By positioning the center of gravity of the golf club head closer to the center of the face of the golf club head, the size of the "sweet spot" of the golf club head (e.g., the area typically in the center of the ball striking face of the golf club head, wherein the trajectory of the golf ball is maximized according to the particular characteristics of the golf club head) may be increased. Also, the golf club head may be more "forgiving" when the golf ball is not struck with the center of the ball striking face (e.g., the errant trajectory of the golf ball may be minimized when the golf ball is struck off center of the golf club head face).

Other iron-type golf club heads according to at least some example aspects of this disclosure may include: (a) an iron-type golf club head body including a ball striking face and a rear surface opposite the ball striking face, wherein the rear surface may include a perimeter weighting member extending rearward from the ball striking face and along at least a portion of a circumferential area of the golf club head body and (b) an insert engaged with the golf club head body and positioned behind the ball striking face of the golf club head.

According to some aspects of this disclosure, "middle" iron-type golf clubs (i.e., irons with a relatively intermediate degree of loft, e.g., a 6-iron, 7-iron) of the set of golf clubs according to aspects of the disclosure may be configured with the above mentioned 2-piece configuration which will be described in detail below. As will be described in detail below, such a 2 piece configuration may provide a center of gravity of the golf club head which relatively low in the golf club head and away from the ball striking face of the golf club head. Providing the center of gravity of the golf club head which is relatively low and towards the rear of the golf club head, may be particularly useful in imparting a more lofted trajectory to the golf ball (e.g., getting the ball in the air).

Further, as will be described in detail below, such a configuration may provide a center of gravity of the golf club head which is more centered, relative to the center of the face of the golf club head. By positioning the center of gravity of the golf club head closer to the center of the face of the golf club head, the size of the "sweet spot" of the golf club head may be increased. Also, the golf club head may be more "forgiving" when the golf ball is struck off center of the ball striking face.

Other iron-type golf club heads according to at least some example aspects of this disclosure may include: (a) an iron-type golf club head body which includes a ball striking face, a rear surface opposite the ball striking face, which may include a perimeter weighting member extending rearward from the ball striking face and along at least a portion of the circumferential area of the golf club head.

According to some aspects of this disclosure, "short" iron-type golf clubs (i.e., irons with a relatively high degree of loft, e.g., a 9-iron, a pitching wedge, other wedges) of the set of golf clubs according to aspects of the disclosure may be configured with the above mentioned 1 piece configuration which will be described in detail below. As will be described in detail below, such a 1 piece configuration may aid a golfer in aid a golfer in increasing the control of the golf shot.

Additional aspects of this disclosure relate to iron-type golf club structures that include golf club heads, e.g., of the types described above. Such iron-type golf club structures further may include one or more of: a shaft member attached to the club head (optionally via a separate hosel member or a hosel member provided as a part of one or more of the club head and/or shaft); a grip or handle member attached to the shaft member; additional weight members; medallions; etc.

Still additional aspects of this disclosure relate to methods for producing iron-type golf club heads and iron-type golf club structures in accordance with examples of this disclosure. Such methods may include, for example, one or more of the following steps in any desired order and/or combinations: (a) providing a golf club head body of the various types described above (including any or all of the various structures, features, and/or arrangements described above), e.g., by manufacturing or otherwise constructing the golf club head body, by obtaining it from a third party source, etc.; (b)

engaging a shaft member with the golf club head body; and (c) engaging a grip member with the shaft member.

Still additional aspects of this disclosure relate to a set of golf clubs which may include one, some or all of the above described golf club heads. For example, one or more of the long irons in the set may include iron-type golf club heads with the 3-piece configuration described in detail below. Further, one or more of the middle irons in the set may include iron-type golf club heads with the 2-piece configuration described in detail below. Additionally, one or more of the short irons in the set may include iron-type golf club heads with the 1-piece configuration described in detail below.

Given the general description of various example aspects of the disclosure provided above, more detailed descriptions of various specific examples of golf clubs and golf club head structures according to the disclosure are provided below.

II. Detailed description of example golf club heads, golf club Structures, and methods according to the disclosure The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

More specific examples and features of iron-type golf club heads and golf club structures according to this disclosure will be described in detail below in conjunction with the example golf club structures illustrated in FIGS. 1-4.

FIG. 1 generally illustrates an example of an iron-type golf club 100 in accordance with the present disclosure. The overall golf club structure 100 of this example includes, a hosel 102, a shaft 104 received in and/or inserted into and/or through the hosel 104, a grip or handle 106 attached to the shaft 104 and a golf club head. Optionally, if desired, the external hosel 102 may be eliminated and the shaft 104 may be directly inserted into and/or otherwise attached to the golf club head (e.g., through an opening provided in the top of the golf club head, through an internal hosel (e.g., provided within an interior chamber defined by the golf club head), etc.). The hosel 102 may be integrally formed as part of the golf club head structure, or it may be separately formed and engaged therewith (e.g., by adhesives or cements; by welding, brazing, soldering, or other fusing techniques; by mechanical connectors; etc.). Conventional hosels and their inclusion in an iron type golf club head structure may be used without departing from this disclosure.

The shaft 104 may be received in, engaged with, and/or attached to the golf club head in any suitable or desired manner, including in conventional manners known and used in the art, without departing from the disclosure. As more specific examples, the shaft 104 may be engaged with the golf club head via a hosel 102 and/or directly to the golf club head structure, e.g., via adhesives, cements, welding, soldering, mechanical connectors (such as threads, retaining elements, or the like), etc.; through a shaft-receiving sleeve or element extending into the golf club head; etc. If desired, the shaft 104 may be connected to the golf club head in a releasable manner using mechanical connectors to allow easy interchange of one shaft for another on the head.

The shaft 104 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member (not shown) may be attached to, engaged with, and/or extend from the shaft 104 in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member 106 may be integrally formed as a unitary, one-piece construction with the shaft 104. Additionally, any desired grip or handle materials may be used without departing from this disclosure, including, for example: rubber materials, leather materials, rubber or other materials including cord or other fabric material embedded therein, polymeric materials, and the like.

The golf club head itself also may be constructed in any suitable or desired manner and/or from any suitable or desired materials without departing from this disclosure, including from conventional materials and/or in conventional manners known and used in the art. For example, as seen in the example structure shown in FIG. 1, the golf club head club head may include a top, or crown, and a sole. The golf club head and/or its various parts may be made by forging, casting, molding, and/or using other techniques and processes, including techniques and processes that are conventional and known in the art.

A wide variety of overall club head constructions are possible without departing from this disclosure. For example, if desired, some or all of the various individual parts of the golf club head described above may be made from multiple pieces that are connected together (e.g., by adhesives or cements; by welding, soldering, brazing, or other fusing techniques; by mechanical connectors; etc.). The various parts (e.g., crown, sole, etc.) may be made from any desired materials and combinations of different materials, including materials that are conventionally known and used in the art, such as metal materials, including lightweight metal materials, composite materials, polymer materials, etc.

The dimensions and/or other characteristics of a golf club head structure according to examples of this disclosure may vary significantly without departing from the disclosure. For example, any iron type club head may be provided including, for example: iron type hybrid clubs, driving irons, 0 through 10 irons, wedges (e.g., pitching wedges, lob wedges, gap wedges, sand wedges, etc.), chipping clubs, etc.

According to aspects of the disclosure, the golf club head may be one of several different embodiments that will be described in detail below. For example, one embodiment of the golf club head according to aspects of the disclosure may be an iron-type golf club head with the above mentioned 3-piece configuration. Further, another embodiment of the golf club head according to aspects of the disclosure may include an iron-type golf club head with the above mentioned 2-piece configuration. Additionally, another embodiment of the golf club head according to aspects of the disclosure may be an iron-type golf club head of the above mentioned 1-piece configuration. Each of these embodiments will be described in detail below.

Figure 2:
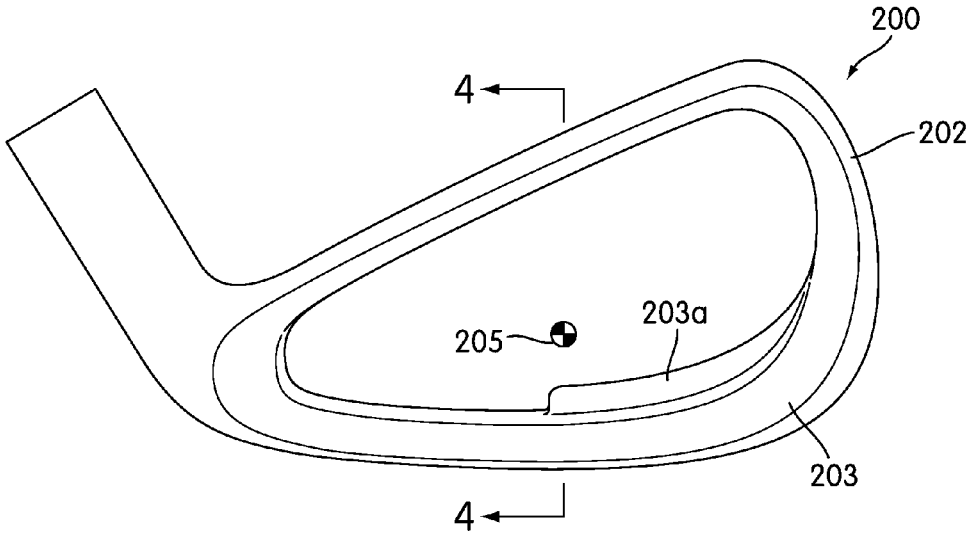
FIG. 2 illustrates a golf club head structure according to at least some examples of this disclosure.
Figure 3:
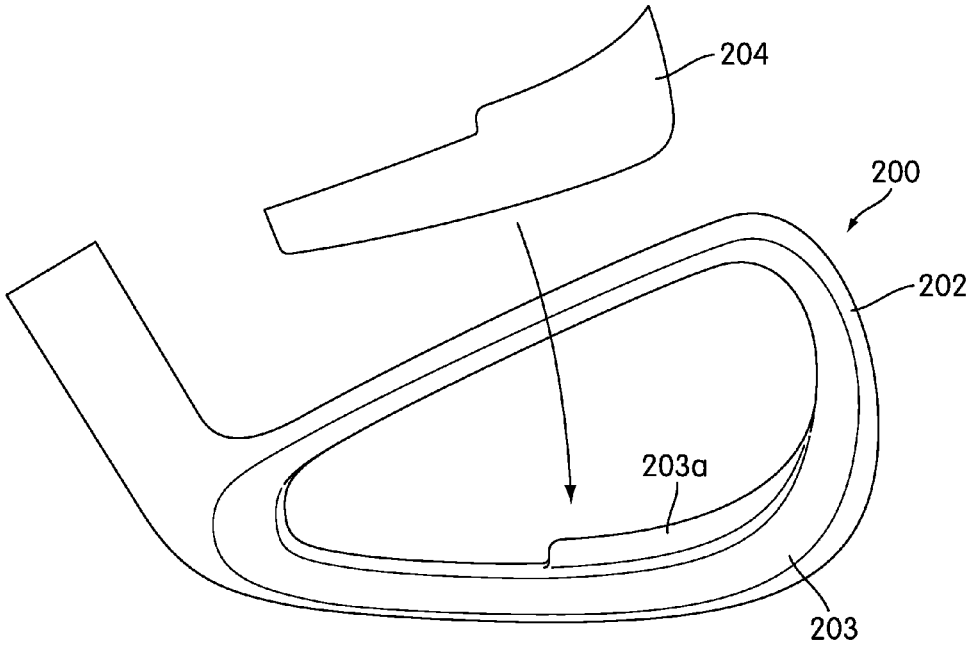
FIG. 3 illustrates an exploded view of the golf club head structure shown in FIG. 2.
Figure 4:
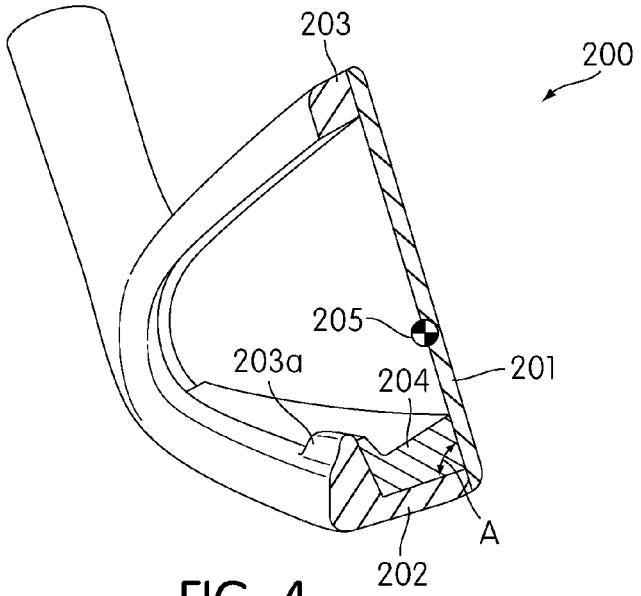
FIG. 4 illustrates cross sectional view of the golf club head structure shown in FIG. 2 taken along line 4-4.
Figure 5:
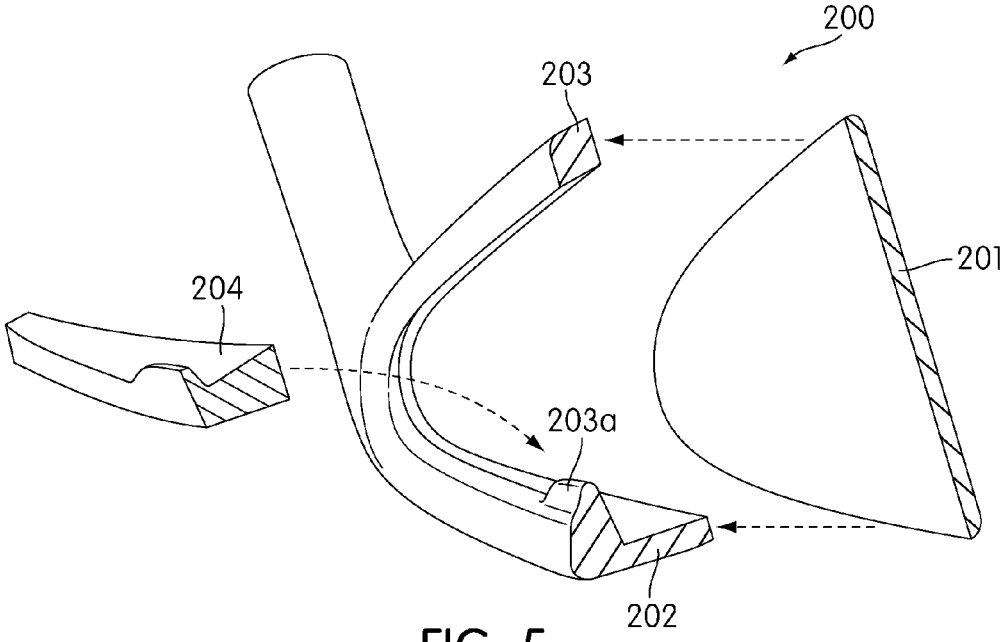
FIG. 5 illustrates an exploded view of the cross section view shown in FIG. 4.

FIGS. 2, 3, 4 and 5 show an illustrative golf club head 200 which includes example features and structures that may be included in golf clubs and golf club head bodies in accordance with examples of this disclosure. FIG. 2 illustrates a rear view of the golf club head 200. FIG. 3 is an exploded view of the golf club head shown in FIG. 2. FIG. 4 is a cross-sectional view of the golf club head 200 along line 4-4 shown in FIG. 2. FIG. 5 is an exploded view of the cross-sectional view shown in FIG. 4.

As seen in FIGS. 2-5, the golf club head 200 may include 3 pieces, including: a (a) ball striking face 201; (b) a golf club head body 202 which may include a perimeter weighting member 203 which may extend in a direction rearwardly from the ball striking face 201 and along at least a portion of a circumferential area of the golf club head body 202; and (c) and an insert 204.

According to aspects of the disclosure, the golf club head 200 may include a first piece or element. For example, as described above, the golf club head 200 may include a ball striking face 201. According to aspects of the disclosure, the ball striking face 201 may be relatively thin. For example, according to aspects of the disclosure, the thickness of the ball striking face 201 may be in a range of: 0.070-0.110 inch, 0.080-0.095 of an inch, 0.085-0.090 of an inch or 0.09-0.11 of an inch. Of course, other thicknesses may be used as well.

Further, according to aspects of the disclosure, the ball striking face 201 may comprise a high strength alloy. For example, the ball striking face 201 may comprise a stainless steel alloy. For example, the ball striking face 201 may comprise AM 355, or CUSTOM 455 STAINLESS, CUSTOM 465 STAINLESS CUSTOM 475 STAINLESS available from Carpenter Technology Corporation of Wyomissing, Pa. Of course, other materials may be used as well. It is noted that according to aspects of the disclosure, a high strength, resilient and durable material may be used so as that the ball striking face 201 is able to withstand the repeated impacts with the golf ball and the general conditions of the golf course environment. For example, other metals, alloys, etc. may be used as desired.

As discussed above, according to aspects of the disclosure, the ball striking face 201 may be a separate element that is engaged with the golf club head body 202. For example, according to aspects of the disclosure, the ball striking face 201 may be welded to the golf club head body 202. For example, the ball striking face 201 may be welded to a front face of the golf club head body 202 around the perimeters of the front face of the golf club head body 202 and the ball striking face 201 (or at least a portion of the perimeters thereof). The perimeter, or "off the face", welding can contribute to providing the relatively thin ball striking face 201.

It is noted that according to aspects of the disclosure, the above described configuration of the ball striking face 201 (including the material comprising the ball striking face 201 and the methods of attaching the ball striking face to the golf club head body 201) may provide a relatively high coefficient of restitution (COR) which may provide an increase of the ball speed when the golf ball leaves the ball striking face 201 after impact. For example, the COR may be in a range of 0.780 to 0.825. The larger amount of ball speed at impact may cause the golf ball to travel a farther distance after impact with the ball striking face 201.

Further, according to aspects of the disclosure, the ball striking face 201 may include one or more score lines. The score lines may interact with the dimpled surface of the golf ball during the impact of the golf club head 200 with a golf ball (e.g., during a golf swing) and affect the aerodynamics of the golf ball during the golf shot. For example, the score lines may cause a spin (e.g., back spin) of the golf ball during the golf shot.

According to aspects of the disclosure, the golf club head 200 may include a second piece or element. For example, the golf club head body 202 may be a separate element with which the ball striking face 201 is engaged (e.g., welded to the golf club head body 202 along at least a portion of the perimeter of the front face of the golf club head body 202).

According to aspects of the disclosure, the golf club head 200 may have a volume in a range of: 28-40 cubic centimeters (cc), 28-32 cc, 33-38 cc or 39-40 cc. Of course, other sizes may be used as well. For example, according to aspects of the disclosure, an example of an embodiment of the golf club head 200 may be a 3-iron, a 4-iron, and a 5-iron with a volume of 28-40 cc. Further, according to aspects of the disclosure, the ball striking face 201 may be comprised of steel. For example, the golf club head body 202 may comprise stainless steel (e.g., 17-4 PH). Of course, other materials may be used as well. For example, other metals, alloys, plastics, polymers, etc., or combinations thereof, may be used as desired. Further, according to aspects of the disclosure, the golf club head body 202 may be formed via casting, forging, etc.

As described above, according to aspects of the disclosure, the golf club head body 200 may include a front face with which the ball striking face 201 may be engaged. According to aspects of the disclosure, the front face along the sole of the golf club head body (and/or the sole of the golf club head body itself) may be configured such that when the ball striking face 201 is engaged with the front face of the golf club head body 200, the lower corner of the cavity formed by the intersection of the ball striking face 201 with the front face of the sole of the golf club head has an angle A that is approximately a 90°. According to aspects of the disclosure, the angle A may be in the range of 85-90°, 88-90°, or 90°. By providing forming that portion of the cavity with a squared off approximately 90° angle, the coefficient of restitution (COR) of the ball striking face 201 may be increased. For example, there is less resistance to movement with a 90° joint than one with a radius. Hence, the speed of the golf ball leaving the ball striking face 201 after impact with the golf club head 200 may be increased and, hence, the golf ball may travel a further distance.

According to aspects of the disclosure, the golf club head body 200 may be configured such the radius of the sole is in a range of approximately 2.0 inches. Therefore, this configuration of the golf club head body 202 may aid in preventing the front surface of the golf club head 200 from digging into the ground during a golf shot. Of course, other ranges may be used if desired.

According to aspects of the disclosure, the perimeter weighting member 203 may define a cavity in the back of the golf club head 200 which is interior relative to the perimeter weighting member 203. According to aspects of the disclosure, the cavity is not sealed so that at least some of the cavity is exposed. For example, as seen in the depicted embodiment, a rear portion of the golf club head 200 may be open so that the cavity may be exposed.

Further, according to aspects of the disclosure, the section of the cavity between along the sole of the golf club head 200, between the perimeter weighting member 203 and the ball striking face 201 may have a length in the range of approximately 1.0-3.5 inches, 2.0-2.75 inches or 2.45-2.50 inches, a width approximately 0.02-0.6 inches, 0.3-0.55 inches or 0.5 inches, and a depth in the range of 0.20-0.5 inches, 0.3-0.4 inches or 0.35 inches.

According to aspects of the disclosure, the perimeter weighting member 203 may include a protrusion **203*a* which extends upwards from the part of the perimeter weighting member 203 that extends along the sole of the golf club head 200. Further, the protrusion 203*a* may extend inwards from a part of the perimeter weighting member 203 that extends along the toe of the golf club head 200. For example, the protrusion 203*a* may extend approximately half the distance across the rear of the golf club head 200 along the part of the perimeter weighting member 203 which extends along the sole of the golf club head 200. According the aspects of the disclosure, the protrusion 203***a* may have a length in the range of 0.5-1.5 inches, 1.0-1.375 inches or 1.25-1.3 inches. Further, according to aspects of the disclosure, the protrusion 203*a* may be recessed or, set back from, the rear edge of the perimeter weighting member 203 of the golf club head 200. Of course, the shape of the protrusion 203*a* may be varied as desired.

According to aspects of the disclosure, the golf club head 200 may include a third piece or element. For example, the golf club head body may include an insert 204. According to aspects of the disclosure, the insert 204 may be configured to be inserted into the cavity defined by the perimeter weighting member 203. For example, the insert 204 may be configured to be inserted into the section of the cavity along the sole of the golf club head 200, and along or adjacent the toe of the golf club head 200, between the perimeter weighting member 203 and the ball striking face 201.

According to aspects of the disclosure, and as seen in FIG. 3, the insert 204 may be shaped to resemble the shape of the perimeter weighting member 203 which extends along the sole of the golf club head 200 and the toe of the golf club head. For example, as seen in FIG. 3, the insert 204 may include a protrusion which resembles the shape of the protrusion 203*a* of the perimeter weighting member 203.

According to aspects of the disclosure, the insert 204 may have length in the range of 1.0-3.0 inches, 2.0-2.75 inches or 2.45-2.50 inches, a width approximately 0.02-0.6 inches, 0.3-0.55 inches or 0.5 inches, and a depth in the range of 0.25-0.5 inches, 0.3-0.4 inches or 0.35 inches. Further, according to aspects of the disclosure, the insert 204 may comprise about 10%, 20% or 30% of the weight of the golf club head 200.

According to aspects, the insert 204 may be comprised of one or more materials. For example, according to aspects of the disclosure, the insert 204 may include a plastic material, such as a thermoplastic polyurethane (TPU) material. Of course, other materials (e.g., other plastic materials, polymers, rubbers (e.g., natural or synthetic), tungsten powder filled rubber polymer, metals, alloys, etc. or combinations thereof) may be used as well. It is noted that according to aspects of the disclosure, a resilient and durable material may be used so as that the insert 204 is able to withstand the general conditions of the golf course environment (e.g., the weather elements, potential repeated impacts with other golf clubs in a golf bag, impacts of the golf club head 200 with the golf ball during a golf shot, etc.). Further, it is noted that according to aspects of the disclosure, the insert 204 may have a density that is higher or lower than the golf club head 200. For example, in an example embodiment the golf club head may have a density of 7.8 grams/cc. Accordingly, the insert 204 may have a density higher or lower than 7.8 grams/cc. According to aspects of the disclosure the insert 204 may have a density in the range of 7-12 grams/cc. Alternatively, according to aspects of the disclosure the insert 204 may have a density in the range of 2-12 grams/cc. Further, it is noted that according to aspects of the disclosure, the insert 204 may have portions of different density. For example, a first portion of the insert 204 may have first density and a second portion of the insert may have second density that is different from the first density. According to particular aspects of the disclosure, portions of different density may be at the heel end or toe end of the insert 204.

According to aspects of the disclosure, the insert 204 may be engaged with the golf club head 202 through a variety of means. For example, the insert 204 may be secured to the golf club head 200 via adhesives, cements, welding, soldering, mechanical connectors (such as threads, retaining elements, snap fit, press fit, or the like), etc. If desired, the insert 204 may be engaged with the golf club head 200 in a releasable manner (e.g., using mechanical connectors) to allow easy interchange of one insert 204 for another.

According to aspects of the disclosure, the insert 204 may include a plurality of recesses (e.g., a honey comb configuration) in its exterior surface. Such a configuration may be utilized to engage the insert 204 in the golf club head 200. For example, a glue, cement or adhesive may be used in conjunction with the plurality of recesses to engage the insert 204 in the golf club head 200.

According to aspects of the disclosure, the insert 204 may have a different weight, a different density, a different weight distribution, and/or other different weighting characteristics than the other parts of the golf club head 200 (e.g., the golf club head body 202, the perimeter weighting member 203 or the ball striking face 201). For instance, the insert 204 may be made relatively heavy as compared to the other parts of the golf club head 200 (e.g., by forming the insert 204 from a different material than the other parts of the golf club head 200, including materials of high density or high specific gravity, such as lead or tungsten, etc., or of one or more materials e.g., TPU containing lead or tungsten, etc., etc.). According to aspects of the disclosure, the insert 204 may have a mass in the range of 40-55 grams, 45-48 grams or 47 grams (of course, other ranges may be used as desired). Hence, it is understood that according to aspects of the disclosure, the insert 204 may provide a relatively large amount of mass and weight.

Therefore, according to some aspects of this disclosure, the insert 204 can be used to alter (e.g., shift) the center of the gravity of the golf club head 200. For example, the size and positioning of the insert 204 may redistribute the mass and weight of the golf club head 200 (e.g., as compared to a differently configured golf club head without an insert) and, thereby, shift golf club head's center of gravity. Therefore, the insert 204 can be selectively sized and positioned to control features of the club head's center of gravity. For example, by sizing and positioning the insert 204, the center of gravity of the club head 200 may be adjusted, vertically (e.g., in the crown to sole direction of the golf club head 200), horizontally (e.g., in the heel to toe direction of the golf club head 200) and in a depth direction (e.g., in a ball striking face to rear surface direction of the golf club head 200).

For illustrative purposes the golf club head 200 may have center of gravity denoted symbolically at reference numeral 205. Therefore, according to aspects of the disclosure, if the above described insert 204 with a mass of 47 grams is inserted into the golf club head body as seen in FIG. 4, the center of gravity 205 of the illustrative golf club head 200 may be positioned in a range of 15.5-19.5 mm upwards from the sole of the golf club head, 8.5-17.0 mm rearwards from the hosel of the golf club (e.g., the axis of the hosel), and within 0.0-1.5 mm of the center of the ball striking face of the golf club head. This location of the center of gravity 205 of the club head body 200 can affect the trajectory and ball flight of a golf ball struck by the golf club.

For example, the above described configuration of such 3 piece irons may provide a center of gravity of the golf club head 205 in a position such as described above which is low in the golf club head and away from the ball striking face 201 of the golf club head 200. Such a configuration may aid a golfer in imparting a more lofted trajectory to the golf ball (e.g., getting the ball in the air). Therefore, such a configuration of the golf club head may be particularly advantageous in "long" irons.

Further, the above described configuration of such 3-piece irons may provide a center of gravity of the golf club head 205 in a position such as described above which is relatively centered relative to the center of the face of the golf club head. By positioning the center of gravity of the golf club head 205 substantially behind the center of the ball striking face 201 of the golf club head 200, the size of the "sweet spot" of the golf club head 200 (the area typically in the center of the ball striking face 201 of the golf club head 200 wherein the trajectory of the golf ball is maximized according to the particular characteristics of the golf club head 200) may be increased. Also, by positioning the center of gravity of the golf club head 205 substantially behind the center of the ball striking face 201 of the golf club head 200, the errant trajectory of the golf ball is minimized when the golf ball struck off center of the ball striking face 201 of the golf club head 200.

The above described configuration of the 3-piece iron which includes the above described relatively thin, ball striking face 201 (including its attachment to the golf club head body 202) and the insert 204 may, therefore, provide a higher ball flight and a lower spin. For example, the location of the center of gravity and the proximity to the center of the ball striking face 201 provides a more efficient transfer of energy. Therefore, the distance the golf ball travels after impact may be increased.

In view of the above, the above described configuration of the 3 piece iron may be particularly advantageous when employed in long irons. Hence, aspects of the disclosure are directed to long irons with a golf club head with the above described 3 piece configuration. For example, particular aspects of the disclosure may relate to a 3-iron, 4-iron or 5-iron with the above described 3 piece configuration. It is noted that the 3-piece configuration may take on a variety of forms (e.g., different dimensions, etc.) without departing from the spirit of disclosure. For example, according to some aspects of this disclosure, the golf club head 200 may include a back cover or medallion which is set in the cavity of the golf club head body 200.

Figure 6:
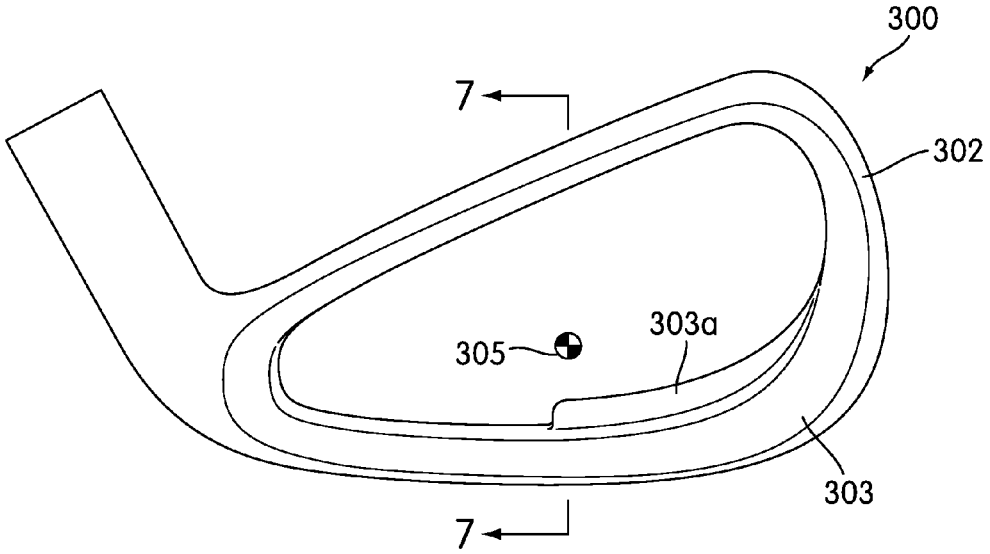
FIG. 6 illustrates a golf club head structure according to at least some examples of this disclosure.
Figure 7:
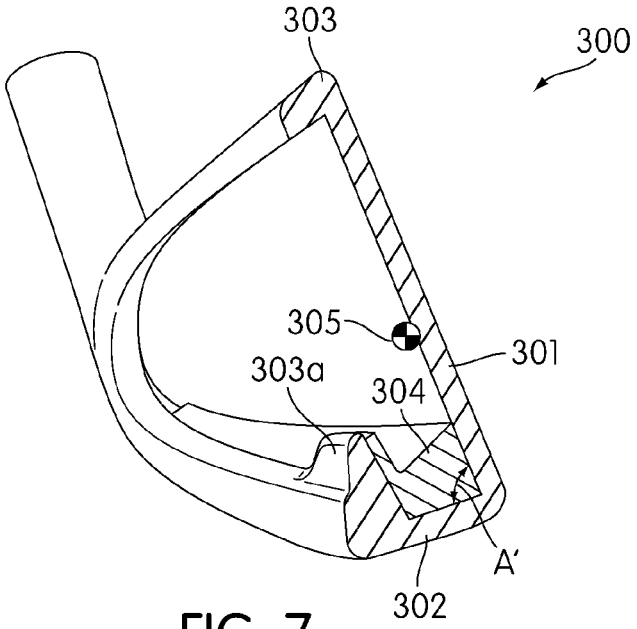
FIG. 7 illustrates cross sectional view of the golf club head structure shown in FIG. 6 taken along line 7-7.
Figure 8:
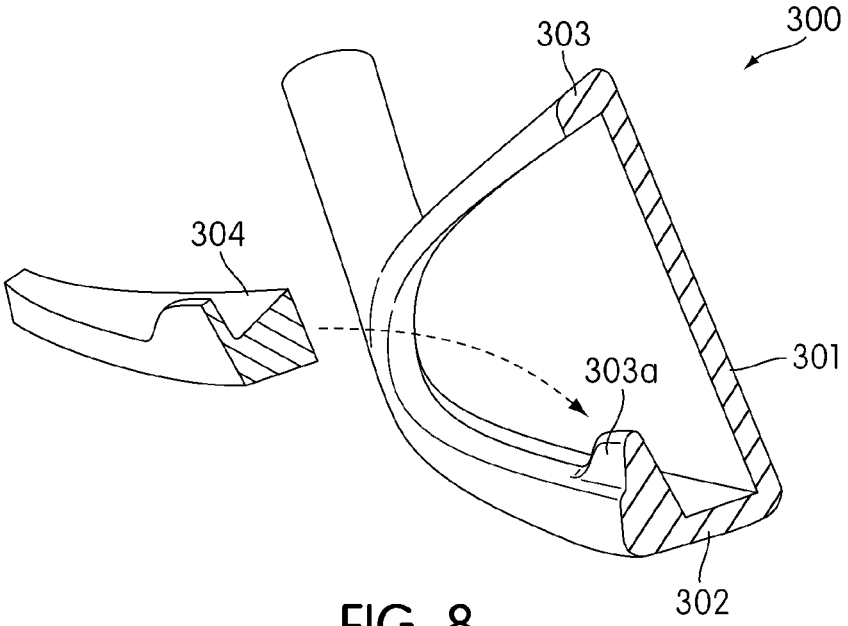
FIG. 8 illustrates an exploded view of the cross section view shown in FIG. 7.

FIGS. 6, 7 and 8 show another illustrative golf club head 300 which includes example features and structures that may be included in golf clubs and golf club head bodies in accordance with examples of this disclosure. FIG. 6 illustrates a rear view of the golf club head 300. FIG. 7 is a cross-sectional view of the golf club head 200 along line 7-7 shown in FIG. 6. FIG. 8 is an exploded view of the cross-sectional view shown in FIG. 7.

As seen in FIGS. 6-8, the golf club head 300 may include 2 pieces, including a (a) a golf club head body 302 which may include ball striking face 301; a perimeter weighting member 303 which may extend in a direction rearwardly from the ball striking face 301 and along at least a portion of a circumferential area of the golf club head body 302; and (b) and an insert 304. Hence it is understood that, according to aspects of the disclosure, one or more elements of the golf club head 300, such as the ball striking face 301, the golf club head body 302 and the perimeter weighting member 303 maybe be formed as a single piece. For example, according to aspects of the disclosure, the golf club head 300 may be formed via casting, forging, etc.

According to aspects of the disclosure, the golf club head 300 may be comprised a high strength metal. For example, the golf club head 300 may comprise a stainless steel or stainless alloy (e.g., 17-4 PH). Of course, other materials such as described above with regard to the previous embodiment may be used as well. According to aspects of the disclosure, the golf club head 300 may have a volume in a range of: 28-40 cubic centimeters (cc), 28-32 cc, 33-38 cc or 39-40 cc. Of course, other sizes may be used as well. For example, according to aspects of the disclosure, an example of an embodiment of the golf club head 300 may be a 6-iron, a 7-iron, and an 8-iron with a volume of 28-40 cc.

As described above, the golf club head 300 may include a ball striking face 301. According to aspects of the disclosure, the ball striking face 301 may be thicker than the ball striking face 201 of the above described embodiment. For example, according to aspects of the disclosure, the thickness of the ball striking face 301 may be in a range of: 0.100 inches-0.145 inches. Further, according to aspects of the disclosure, the ball striking face 201 may be 0.100 inches while the ball striking face 301 may be 0.130 inches.

According to aspects of the disclosure, the ball striking face 301 may include a face plate integrally formed with ball striking face 301 or otherwise engaged with ball striking face 301. Further, according to aspects of the disclosure, the ball striking face 301 (or faceplate) may include one or more score lines which provide the same function as discussed above with regard to the embodiment shown in FIGS. 2-5.

According to aspects of the disclosure, the golf club head body 300 may be configured such that the lower corner of the cavity formed by the intersection of the ball striking face 301 with the sole of the golf club head is approximately a 90° angle. According to aspects of the disclosure, the angle may be in the range of 85-90°, 88-90°, or 90°. For example, the integral golf club head body 300 may be cast, or forged, such that the cavity created between the perimeter weighting member 303 and the ball striking face 301 may include an angle A' in the lower corner defined by the sole and the ball striking face which is in the ranges discussed above.

As discussed above with regard to the previous embodiment, by providing that part of the cavity with an angle of approximately 90° angle, the coefficient of restitution (COR) of the ball striking face 301 may be increased. Hence, as described above with regard to the previous embodiment, the speed of the golf ball leaving the ball striking face 301 after impact with the golf club head 300 may be increased and, hence, the golf ball may travel a further distance.

According to aspects of the disclosure, the golf club head body 300 may be configured such the radius of the sole is in a ranges described above with regard to the previous embodiment.

According to aspects of the disclosure, the perimeter weighting member 303 may define a cavity in the back of the golf club head 300 which is interior relative to the perimeter weighting member 303. According to aspects of the disclosure, the perimeter weighting member 303 and the cavity in the back of the golf club head 300 may be similar to the above described embodiment and, therefore, for the sake of brevity will not be elaborated on here in detail. However, it is noted that the, according to aspects of the disclosure, the perimeter weighting member 303 may include a protrusion **303*a* which is similar to the protrusion 203*a*** of the above described embodiment.

According to aspects of the disclosure, the golf club head 300 may include a second piece or element. For example, the golf club head body may include an insert 304. According to aspects of the disclosure, the insert 304 may be configured to be inserted into the cavity defined by the perimeter weighting member 303. For example, the insert 304 may be configured to be inserted into the cavity along the sole of the golf club head 300, and along or adjacent the toe of the golf club head 300, between the perimeter weighting member 303 and the ball striking face 301.

Further, according to aspects of the disclosure, the insert 304 may be similar to the insert 204 in the above described embodiment and, therefore, for the sake of brevity, details of the insert 304 will not be elaborated on here in detail. However, it is noted that the, according to aspects of the disclosure, the insert 304 may have a different weight, a different density, a different weight distribution, and/or other different weighting characteristics than the other elements of the golf club head 300 (e.g., the golf club head body 302, the perimeter weighting member 303 or the ball striking face 301). For instance, the insert 304 may be made relatively heavy as compared to the other parts of the golf club head 300 (e.g., by forming the insert 304 from a different material than the other parts of the golf club head 300, including materials of high density or high specific gravity, such as lead or tungsten, etc., or of one or more materials e.g., TPU containing lead or tungsten, etc., etc.). According to aspects of the disclosure, the insert 304 may have a mass in the range of 40-55 grams, 45-48 grams or 47 grams (of course, other ranges may be used as desired). Hence, it is understood that according to aspects of the disclosure, the insert 304 may provide a relatively large amount of mass and weight.

Therefore, according to some aspects of this disclosure, the insert 304 can be used to alter (e.g., shift) the center of the gravity of the golf club head 300. For example, the size and positioning of the insert 304 may redistribute the mass and weight of the golf club head 300 (e.g., as compared to a differently configured golf club head without an insert) and, thereby, shift golf club head's center of gravity. Therefore, the insert 304 can be selectively sized and positioned to control features of the club head's center of gravity. For example, by sizing and positioning the insert 304, the center of gravity of the club head 300 may be adjusted, vertically (e.g., in the crown to sole direction of the golf club head 300), horizontally (e.g., in the heel to toe direction of the golf club head 300) and in a depth direction (e.g., in a ball striking face to rear surface direction of the golf club head 300).

For illustrative purposes the golf club head 300 may have center of gravity denoted symbolically at reference numeral 305. Therefore, according to aspects of the disclosure, if the above described insert 304 with a mass of 47 grams is inserted into the golf club head body as seen in FIG. 7, the center of gravity 305 of the illustrative golf club head 300 may be positioned in a range of 15.5-19.5 mm upwards from the sole of the golf club head, 8.5-17.0 mm rearwards from the hosel (e.g., the axis of the hosel) and within 0.0-1.5 mm of the center of the ball striking face of the golf club head. This location of the center of gravity 305 of the club head body 300 can affect the trajectory and ball flight of a golf ball struck by the golf club.

For example, the above described configuration of such 2-piece irons may provide a center of gravity of the golf club head 305 in a position such as described above which is low in the golf club head and away from the ball striking face 301 of the golf club head 300. Such a configuration may aid a golfer in imparting a more lofted trajectory to the golf ball (e.g., getting the ball in the air). Therefore, such a configuration of the golf club head may be advantageous in "middle" irons.

Further, the above described configuration of such 2-piece irons may provide a center of gravity of the golf club head 305 in a position such as described above which is relatively centered relative to the center of the face of the golf club head. By positioning the center of gravity of the golf club head 305 substantially behind the center of the ball striking face 301 of the golf club head 300, the size of the "sweet spot" of the golf club head 300 may be increased. Also, by positioning the center of gravity of the golf club head 305 substantially behind the center of the ball striking face 301 of the golf club head 300, the errant trajectory of the golf ball when the golf ball struck off center of the ball striking face 301 of the golf club head 300 is minimized.

The above described configuration of the 2 piece iron which includes the above described 90° angle in the cavity behind the ball striking face 301 and the above described insert 304 may therefore provide a higher ball flight and a lower spin. For example, as described above, the location of the center of gravity and the proximity to the center of the ball striking face 301 provides a more efficient transfer of energy. Therefore, the distance the golf ball travels after impact may be increased.

In view of the above, the above described configuration of the 2 piece iron may be particularly advantageous when employed in middle irons. Hence, aspects of the disclosure are directed to middle irons with a golf club head with the above described 2 piece configuration. For example, particular aspects of the disclosure may relate to a 6-iron, 7-iron or 8-iron with the above described 2 piece configuration. It is noted that the 2 piece configuration may take on a variety of forms (e.g., different dimensions, etc.) without departing from the spirit of disclosure. For example, according to some aspects of this disclosure, the golf club head 300 may include a back cover or medallion which is set in the cavity of the golf club head body 300.

Figure 9:
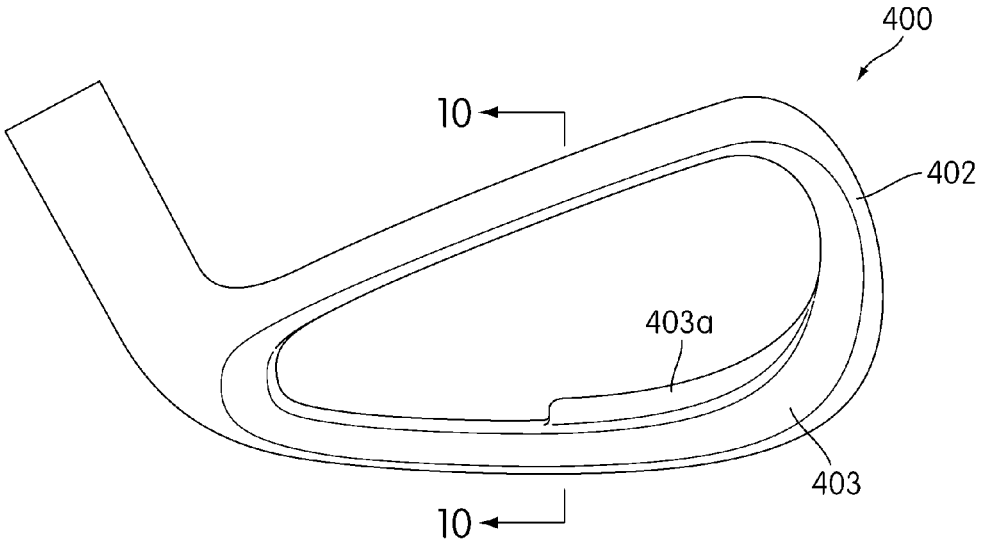
FIG. 9 illustrates a golf club head structure according to at least some examples of this disclosure.
Figure 10:
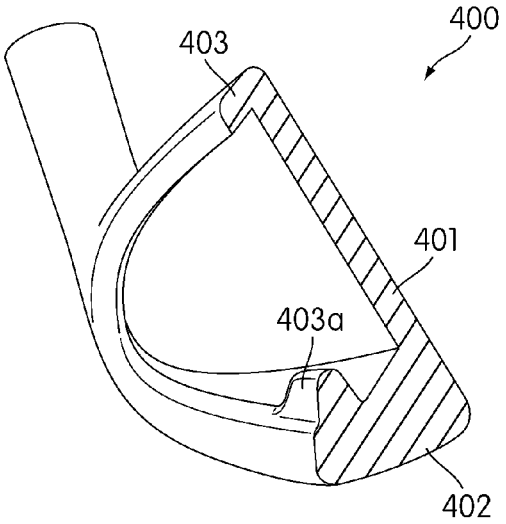
FIG. 10 illustrates cross sectional view of the golf club head structure shown in FIG. 9 taken along line 10-10.

FIGS. 9 and 10 show an illustrative golf club head 400 which includes example features and structures that may be included in golf clubs and golf club head bodies in accordance with examples of this disclosure. FIG. 9 illustrates a rear view of the golf club head 400. FIG. 10 is a cross-sectional view of the golf club head 200 along line 10-10 shown in FIG. 9.

As seen in FIGS. 9 and 10, the golf club head 400 may include a single piece, including a ball striking face 401 and a golf club head body 402 which may include a perimeter weighting member 403 which may extend in a direction rearwardly from the ball striking face 401 and along at least a portion of a circumferential area of the golf club head body 402. Hence it is understood that, according to aspects of the disclosure, one or more elements of the golf club head 400, such as the ball striking face 401, the golf club head body 402 and the perimeter weighting member 403 maybe be formed in a 1 piece configuration. For example, according to aspects of the disclosure, the golf club head 400 may be formed via casting, forging, etc.

According to aspects of the disclosure, the golf club head 400 may comprise a high strength metal. For example, the golf club head 400 may comprise a stainless steel or steel alloy. Of course, other materials such as described above with regard to the previous embodiments may be used as well. According to aspects of the disclosure, the golf club head 300 may have a volume in a range of: 28-40 cubic centimeters (cc), 28-32 cc, 33-38 cc or 39-40 cc. Of course, other sizes may be used as well.

As described above, the golf club head 400 may include a ball striking face 401. According to aspects of the disclosure, the ball striking face 401 may be thicker than the ball striking face 201 or the ball striking face 301 of the above described embodiments. For example, according to aspects of the disclosure, the thickness of the ball striking face 401 may be in a range of: 0.100 inches-0.145 inches. Further, according to aspects of the disclosure, the ball striking face 201 may be 0.100 inches and the ball striking face 301 may be 0.130 inches, while the ball striking face 401 may be 0.145 inches. It is noted that according to aspects of the disclosure, the embodiment with the ball striking face 201 may relate to 3, 4 and/or 5-irons, the embodiment with the ball striking face 301 may relate to 6, 7 and/or 8-irons, and the embodiment with the ball striking face 401 may relate to 9-irons and/or wedges (e.g., a pitching wedge). Of course, other thickness may be used as well.

According to aspects of the disclosure, the ball striking face 401 may include a face plate integrally formed with ball striking face 401 or otherwise engaged with ball striking face 401. Further, according to aspects of the disclosure, the ball striking face 401 (or faceplate) may include one or more score lines which provide the same function as discussed above with regard to the embodiment shown in FIGS. 2-5.

According to aspects of the disclosure, the golf club head body 400 may be configured such the radius of the sole is in a range such as described above with regard to the previous embodiments.

According to aspects of the disclosure, the perimeter weighting member 403 may define a cavity in the back of the golf club head 400 which is interior relative to the perimeter weighting member 403. According to aspects of the disclosure, the perimeter weighting member 403 and the cavity in the back of the golf club head 400 may be similar to the above described embodiment and, therefore, for the sake of brevity will not be elaborated on here in detail. However, it is noted that the, according to aspects of the disclosure, the perimeter weighting member 403 may include a protrusion 403*a* which is similar to the protrusions 203*a* and 303*a* of the above described embodiments.

According to aspects of the disclosure, the golf club head 400 may include a thicker sole, which may reduce the size of at least some of a cavity defined by the perimeter weighting member 403 (e.g., reduce the size of at least some of the cavity as compared with e.g., the above described 3- and 2-piece configurations). For example, as shown in FIG. 10, the thicker sole of the golf club head 400 may be configured to extend between the perimeter weighting member 403 and the ball striking face 401 in a manner similar to the insert 204 or 304 of the above described 3- and 2-piece configurations. For example, the depth or thickness of the sole may be in the range of 0.250-0.900 inches, 0.3-0.750 inches, or 0.5 inches. Therefore, the thicker sole may provide a relatively large amount of mass and weight in a lower part of the golf club head.

Therefore, according to some aspects of this disclosure, the thicker sole of the golf club head body 400 can be used to alter (e.g., shift) the center of the gravity of the golf club head 400. For example, the size of the sole may redistribute the mass and weight of the golf club head 400 (e.g., as compared to a differently configured golf club head without such a thick sole) and, thereby, shift golf club head's center of gravity. Therefore, the sole can be selectively sized and configured to control features of the club head's center of gravity. For example, by sizing and configuring the sole, the center of gravity of the club head 400 may be adjusted, vertically (e.g., in the crown to sole direction of the golf club head 400), horizontally (e.g., in the heel to toe direction of the golf club head 400) and in a depth direction (e.g., in a ball striking face to rear surface direction of the golf club head 400). However, it is noted that without the additional weight of the inserts 204 or 304 described in the previous embodiments, the club head's center of gravity may not be shifted as low as the embodiments with the inserts 204 or 304.

According to aspects of the disclosure, the center of gravity of the illustrative golf club head 400 may be positioned in a range of 0.687 inches from the sole of the golf club head, 0.440 inches away from the front surface of the sole of the golf club head and within 1.48 inches from the center of the ball striking face of the golf club head. This location of the center of gravity of the club head body 400 can affect the trajectory and ball flight of a golf ball struck by the golf club.

For example, the above described configuration of such 1 piece irons may provide a center of gravity of the golf club head in a position such as described above which is low in the golf club head body and away from the ball striking face 401 of the golf club head 400. Such a configuration may aid a golfer in imparting a more lofted trajectory to the golf ball (e.g., getting the ball in the air). However, with less mass and weight in the lower region of the golf club head body 400, as compared with the previous embodiments with the inserts 204 and 304, such as configuration as described with regard to the 1 piece embodiment may prevent a ballooning type golf shot, may provide more control than if the golf club head contained an insert similar to inserts 204 and 304.

In view of the above, the above described configuration of the 1 piece iron may be particularly advantageous when employed in short irons. Hence, aspects of the disclosure are directed to short irons with a golf club head with the above described 1 piece configuration. For example, particular aspects of the disclosure may relate to a 9-iron, pitching wedge or other wedges with the above described 1 piece configuration. It is noted that the 1 piece configuration may take on a variety of forms (e.g., different dimensions, etc.) without departing from the spirit of disclosure. For example, according to some aspects of this disclosure, the golf club head 400 may include a back cover or medallion which is set in the cavity of the golf club head body 400.

Aspects of this disclosure relate to a set of golf clubs which may include one, some or all of the above described iron type golf club heads. For example, according to aspects of the disclosure, one or more of the long irons in the set may include the 3-piece iron-type golf club heads described above. Further, one or more of the middle irons in the set may include the 2-piece iron-type golf club heads described above. Additionally, one or more of the short irons in the set may include the 1-piece, iron-type golf club heads described above.

By providing the a set of golf clubs with each of the above described types of the golf club heads, the golfer may be able to utilize the advantageous of each of the types of the golf club heads in the set. For example, the 3-piece configuration of FIG. 2-5 provides a lower center of gravity, a higher ball flight, a low spin. Therefore, such a 3-piece configuration may be used in the "long" irons of a set of golf clubs according to aspects of the disclosure, because such characteristics may be useful in "long" irons to aid a golfer in imparting a trajectory to the golf ball with less spin, further roll and a relatively longer ball flight which will tend to increase the distance that the golf ball will travel upon being struck by the golfer.

Additionally, the 2-piece iron-type golf club heads shown in FIGS. 6-8 may provide a lower center of gravity, an intermediately higher ball flight, and a low spin. Therefore, such a 2-piece configuration may be used in the "middle" irons of a set of golf clubs according to aspects of the disclosure, because such characteristics may be useful in "middle" irons to aid a golfer in imparting an intermediately lofted trajectory to the golf ball with less spin, further roll and a relatively longer ball flight which will tend to increase the distance that the golf ball will travel upon being struck by the golfer.

Additionally, the 1-piece iron-type golf club heads shown in FIGS. 9 and 10 may provide a lower center of gravity, a relatively higher ball flight that less like to balloon or pop-up.

Therefore, such a 1-piece configuration may be used in the "short" irons of a set of golf clubs according to aspects of the disclosure, because such characteristics may be useful in "short" irons to aid a golfer in imparting such a lofted trajectory to the golf ball. Hence, such a configuration of the golf club head may be particularly advantageous in "short" irons. Therefore, it is understood that providing the particular types of golf club heads described above may produce a set of golf clubs with desirable characteristics.

It is noted that while the particular set of golf clubs described above has 3-piece configured golf club heads in long irons, 2-piece configured golf club heads in middle irons and 1-piece configured golf club heads in short irons and wedges, other combinations may be used as desired. For example, any of the above described types of iron type golf club head structure may be used in any of 0-10 irons, wedges (e.g., iron type clubs having lofts from 44-68 degrees, such as pitching wedges, lob wedges, sand wedges, gap wedges, etc.), etc. Further, in accordance with at least some examples of this disclosure, golf clubs and/or golf club heads in accordance with examples of this disclosure may be sold or marketed as a set including plural irons, including, for example, sets having 0-10 irons, pitching wedges, lob wedges, sand wedges, gap wedges, and/or chipping clubs. When present in a set, any desired number of the clubs in the set may have one or more of the three types of golf club heads in accordance with this disclosure. In some more specific examples, sets of golf clubs in accordance with this disclosure may contain at least the 3-9 irons and a pitching wedge, wherein at least two of these irons (and in some examples, all of these irons) will have a golf club head in accordance with examples of this disclosure. As another example, sets of golf clubs in accordance with this disclosure will contain at least the 4-9 irons (or even 5-9 irons or 6-9 irons) and a pitching wedge, and optionally a sand wedge and/or one or more iron type hybrid clubs, wherein at least two of these clubs (and in some examples, all of these irons) will have a golf club head in accordance with examples of this disclosure.

III. CONCLUSION

The present disclosure is described above and in the accompanying drawings with reference to a variety of example structures, features, elements, and combinations of structures, features, and elements. The purpose served by the disclosure, however, is to provide examples of the various features and concepts related to the disclosure, not to limit the scope of the disclosure. One skilled in the relevant art will recognize that numerous variations and modifications may be made to the embodiments described above without departing from the scope of the present disclosure, as defined by the appended claims. For example, the various features and concepts described above in conjunction with FIGS. 1 through 10 may be used individually and/or in any combination or subcombination without departing from this disclosure.

We claim:

1. A set of iron type golf clubs comprising at least two iron type golf clubs with iron type golf club heads, wherein at least one of the at least two iron type golf club heads includes:

a first type of iron type golf club head, which includes:

a ball striking face;

a golf club head body which is a separate element from the ball striking face and configured to be engaged with the ball striking face, and includes:

a perimeter weighting member extending in a direction rearwardly from the ball striking face and along at least a portion of a circumferential area of the golf club head body, wherein the perimeter weighting member includes a protrusion which extends upwards from a sole portion of the perimeter weighting member that extends along a sole of the golf club head;

a cavity which is defined by the perimeter weighting member and ball striking face, such that at least a portion of the cavity is positioned between the perimeter weighting member and the ball striking face, wherein the protrusion of the perimeter weighting member as an inner surface facing into the cavity; and a weighted insert contained within the cavity and inserted in the portion of the cavity between the perimeter weighting member and the ball striking face and along the sole of the golf club head, wherein the weighted insert includes a second protrusion extending upward from a top surface of the weighted insert and along the inner surface of the protrusion of the perimeter weighting member;

wherein at least one of the at least two iron type golf club heads includes:

a second type of iron type golf club head, which includes:

a single, integral golf club head body which includes:

a ball striking face;

a perimeter weighting member extending in a direction rearwardly from the ball striking face and along at least a portion of a circumferential area of the golf club head body, wherein the perimeter weighting member includes a protrusion which extends upwards from a sole portion of the perimeter weighting member that extends along a sole of the golf club head; and a cavity which is defined by the perimeter weighting member and ball striking face, such that at least a portion of the cavity is positioned between the perimeter weighting member and the ball striking face, wherein the protrusion of the perimeter weighting member has an inner surface facing into the cavity; and a weighted insert contained within the cavity and inserted in the portion of the cavity between the perimeter weighting member and the ball striking face and along the sole of the golf club head, wherein the weighted insert includes a second protrusion extending upward from a top surface of the weighted insert and along the inner surface of the protrusion of the perimeter weighting member.

2. A set of iron type golf clubs according to claim 1, further comprising at least a third iron type golf club with a iron type golf club head, wherein the third type of iron type golf club head includes:

a single integral golf club head body which includes:

a ball striking face;

a perimeter weighting member extending in a direction rearwardly from the ball striking face and along at least a portion of a circumferential area of the golf club head body, wherein the perimeter weighting member includes a protrusion which extends upwards from a sole portion of the perimeter weighting member that extends along a sole of the golf club head; and a cavity which is defined by the perimeter weighting member and ball striking face and at least a portion of the cavity is positioned between the perimeter weighting member and the ball striking face, wherein the protrusion of the perimeter weighting member has an inner surface facing into the cavity, wherein the third type of iron type golf club head has a sole thickness that is greater than thicknesses of the soles of the first and second types of iron type golf club heads, such that the cavity of the third type of iron type golf dub head has a depth that is smaller than the cavities of the first and second types of iron type golf club heads, and wherein the third type of iron type golf club head does not include a weighted insert between the perimeter weighting member and the ball striking face and along the sole of the golf club head.

3. A set of iron type golf clubs according to claim 2, wherein the set of golf clubs includes a 4 iron and the 4 iron includes the first type of golf club head.

4. A set of iron type golf clubs according to claim 3, wherein the set of golf clubs includes a 6 iron and a 7 iron, and the 6 iron and the 7 iron each include the second type of golf club head.

5. A set of iron type golf clubs according to claim 4, wherein the set of golf clubs includes a 9 iron and one or more wedges, and the 9 iron and the one or more wedges each include the third type of golf club head.

6. A set of iron type golf clubs according to claim 1, wherein the weighted insert comprises thermoplastic polyurethane and tungsten.

7. A set of iron type golf clubs according to claim 1, wherein the ball striking face of the first type of golf club head is welded onto the first golf club head body.

8. A set of iron type golf clubs according to claim 7, wherein the ball striking face has a thickness in the range of 0.9-0.11 inches.

9. A set of iron type golf clubs according to claim 1, the golf club head body of the second type of iron type golf club head may be configured such that the cavity includes a lower corner which is formed by the intersection of the ball striking face with the sole of the golf club head wherein the angle is 90°.

10. A set of iron type golf clubs according to claim 2, wherein the set of golf clubs includes a 4 iron and a 5 iron, the 4 iron and the 5-iron each include the first type of golf club head.

11. A set of iron type golf clubs according to claim 10, wherein the set of golf clubs includes a 6 iron, a 7 iron and an 8 iron, and the 6 iron, the 7 iron and the 8 iron each include the second type of golf club head.

12. A set of iron type golf clubs according to claim 11, wherein the set of golf clubs includes a 9 iron and one or more wedges, and the 9 iron and the one or more wedges each include the third type of golf club head.

13. A set of iron type golf clubs according to claim 1, wherein at least a portion of the weighted insert has a higher density than a density of the iron type golf club head into which the weighted insert is inserted.

14. A set of iron type golf clubs according to claim 13, wherein the weighted insert has a first portion with a first density and a second portion with a second density which is different from the first density.

15. A set of iron type golf clubs according to claim 1, wherein the set of golf clubs includes a 3 iron, a 4 iron, a 5 iron, a 6 iron and a 7 iron and the 3 iron, the 4 iron, the 5 iron, the 6 iron and the 7 iron each include the first type of golf club head.

16. A set of iron type golf clubs according to claim 15, wherein the set of golf clubs includes an 8 iron, a 9 iron and one or more wedges, and the 8 iron, the 9 iron and the one or more wedges each include the second type of golf club head.

17. A set of iron type golf clubs according to claim 1, wherein the weighted insert comprises a tungsten powder filed rubber polymer.

18. A set of iron type golf clubs comprising at least three iron type golf clubs with iron type golf club heads, wherein at least one of the at least three iron type golf club heads includes:

a first type of iron type golf club head, which includes:

a ball striking face which has a thickness in the range of 0.9-0.11 inches;

a golf club head body which is a separate element from the ball striking face and configured to be welded to ball striking face around a perimeter of the ball striking face, wherein the golf club head body includes:

a perimeter weighting member extending in a direction rearwardly from the ball striking face and along at least a portion of a circumferential area of the golf club head body, wherein the perimeter weighting member includes a protrusion which extends upwards from a sole portion of the perimeter weighting member that extends along a sole of the golf club head;

a cavity which is defined by the perimeter weighting member and ball striking face, such that at least a portion of the cavity is positioned between the perimeter weighting member and the ball striking face, wherein the protrusion of the perimeter weighting member has an inner surface facing into the cavity; and a weighted insert contained within the cavity and inserted in the portion of the cavity between the perimeter weighting member and the ball striking face and along the sole of the golf club head, wherein the weighted insert includes a second protrusion extending upward from a top surface of the weighted insert and along the inner surface of the protrusion of the perimeter weighting member;

wherein at least one of the at least three iron type golf club heads includes:

a second type of iron type golf club head, which includes:

a single, integral golf club head body which includes:

a ball striking face;

a perimeter weighting member extending in a direction rearwardly from the ball striking face and along at least a portion of a circumferential area of the golf club head body, wherein the perimeter weighting member includes a protrusion which extends upwards from a sole portion of the perimeter weighting member that extends along a sole of the golf club head; and a cavity which is defined by the perimeter weighting member and ball striking face, such that at least a portion of the cavity is positioned between the perimeter weighting member and the ball striking face, wherein the protrusion of the perimeter weighting member has an inner surface facing into the cavity; and a weighted insert contained within the cavity and inserted in the portion of the cavity between the perimeter weighting member and the ball striking face and along the sole of the golf club head, wherein the weighted insert includes a second protrusion extending upward from a top surface of the weighted insert and along the inner surface of the protrusion of the perimeter weighting member, wherein at least one of the at least three iron type golf club heads includes:

a third type of iron type golf club head, which includes:

a single integral golf club head body which includes:

a ball striking face;

a perimeter weighting member extending in a direction rearwardly from the ball striking face and along at least a portion of a circumferential area of the golf club head body, wherein the perimeter weighting member includes a protrusion which extends upwards from a sole portion of the perimeter weighting member that extends along a sole of the golf club head; and a cavity which is defined by the perimeter weighting member and ball striking face and at least a portion of the cavity is positioned between the perimeter weighting member and the ball striking face, wherein the protrusion of the perimeter weighting member has an inner surface facing into the cavity, wherein the third type of iron type golf club head has a sole thickness that is greater than thicknesses of the soles of the first and second types of iron type golf club heads, such that the cavity of the third type of iron type golf club head has a depth that is smaller than the cavities of the first and second types of iron type golf club heads, and wherein the third type of iron type golf club head does not include a weighted insert between the perimeter weighting member and the ball striking face and along the sole of the golf club head.

19. A set of iron type golf clubs according to claim 18, wherein the set of golf clubs includes a 4 iron and the 4 iron includes the first type of golf club head.

20. A set of iron type golf clubs according to claim 19, wherein the set of golf clubs includes a 6 iron and a 7 iron, and the 6 iron and the 7 iron each include the second type of golf club head.

21. A set of iron type golf clubs according to claim 20, wherein the set of golf clubs includes a 9 iron and one or more wedges, and the 9 iron and the one or more wedges each include the third type of golf club head.

22. A set of iron type golf clubs according to claim 18, wherein the set of golf clubs includes a 4 iron and a 5 iron, the 4 iron and the 5-iron each include the first type of golf club head.

23. A set of iron type golf clubs according to claim 22, wherein the set of golf clubs includes a 6 iron, a 7 iron and an 8 iron, and the 6 iron, the 7 iron and the 8 iron each include the second type of golf club head.

24. A set of iron type golf clubs according to claim 23, wherein the set of golf clubs includes a 9 iron and one or more wedges, and the 9 iron and the one or more wedges each include the third type of golf club head.

25. A set of iron type golf clubs according to claim 18, wherein the weighted inserts comprises thermoplastic polyurethane and tungsten.

26. A set of iron type golf clubs according to claim 18, the golf club head body of the second type of iron type golf club head may be configured such that the cavity includes a lower corner which is formed by the intersection of the ball striking face with the sole of the golf club head wherein the angle is 90°.

27. A set of iron type golf clubs comprising at least two iron type golf clubs with iron type golf club heads, wherein at least one of the at east two iron type golf club heads includes:

a first type of iron type golf club head, which includes:

a ball striking face;

a golf club head body which is a separate element from the ball striking face and configured to be engaged with the ball striking face, and includes:

a perimeter weighting member extending in a direction rearwardly from the ball striking face and along at least a portion of a circumferential area of the golf club head body, wherein the perimeter weighting member includes a protrusion which extends upwards from a sole portion of the perimeter weighting member that extends along a sole of the golf club head;

a cavity which is defined by the perimeter weighting member and ball striking face, such that at least a portion of the cavity is positioned between the perimeter weighting member and the ball striking face, wherein the protrusion of the perimeter weighting member has an inner surface facing into the cavity; and a weighted insert contained within the cavity and inserted in the portion of the cavity between the perimeter weighting member and the ball striking face and along the sole of the golf club head, wherein the weighted insert includes a second protrusion extending upward from a top surface of the weighted insert and along the inner surface of the protrusion of the perimeter weighting member;

wherein at least one of the at least two iron type golf club heads includes:

a second type of iron type golf club head, which includes:

a single integral golf club head body which includes:

a ball striking face;

a perimeter weighting member extending in a direction rearwardly from the ball striking face and along at least a portion of a circumferential area of the golf club head body, wherein the perimeter weighting member includes a protrusion which extends upwards from a sole portion of the perimeter weighting member that extends along a sole of the golf club head; and a cavity which is defined by the perimeter weighting member and ball striking face and at least a portion of the cavity is positioned between the perimeter weighting member and the ball striking face, wherein the protrusion of the perimeter weighting member has an inner surface facing into the cavity, wherein the second type of iron type golf club head has a sole thickness that greater than thicknesses of the sole of the first type of iron type golf club head, such that the cavity of the second type of iron type golf club head has a depth that is smaller than the cavity of the first type of iron type golf club head, and wherein the second type of iron type golf club head does not include a weighted insert between the perimeter weighting member and the ball striking face and along the sole of the golf club head.

28. A set of iron type golf clubs according to claim 27, wherein the set of golf clubs includes a 4 iron and the 4 iron includes the first type of golf club head.

29. A set of iron type golf clubs according to claim 28, wherein the set of golf clubs includes a 9 iron and one or more wedges, and the 9 iron and the one or more wedges each include the second type of golf club head.

30. A set of iron type golf clubs according to claim 27, wherein the set of golf clubs includes a 4 iron and a 5 iron and the 4 iron and the 5 iron each include the first type of golf club head.

31. A set of iron type golf clubs according to claim 27, wherein the weighted insert comprises thermoplastic polyurethane and tungsten.

32. A set of iron type golf clubs according to claim 27, wherein the ball striking face of the first type of golf club head has a thickness in the range of 0.9-0.11 inches and is welded onto the first golf club head body.

33. A set of iron type golf clubs comprising at least two iron type golf clubs with iron type golf club heads, wherein at least one of the at least two iron type golf club heads includes:

a first type of iron type golf club head, which includes:

a single, integral golf club head body which includes:

a ball striking face;

a perimeter weighting member extending in a direction rearwardly from the ball striking face and along at least a portion of a circumferential area of the golf club head body, wherein the perimeter weighting member includes a protrusion which extends upwards from a sole portion of the perimeter weighting member that extends along a sole of the golf club head; and a cavity which is defined by the perimeter weighting member and ball striking face, such that at least a portion of the cavity is positioned between the perimeter weighting member and the ball striking face, wherein the protrusion of the perimeter weighting member has an inner surface facing into the cavity; and a weighted insert contained within the cavity and inserted in the portion of the cavity between the perimeter weighting member and the ball striking face and along the sole of the golf club head wherein the weighted insert includes a second protrusion extending upward from a top surface of the weighted insert and along the inner surface of the protrusion of the perimeter weighting member;

wherein at least one of the at least two iron type golf club heads includes:

a second type of iron type golf club head, which includes:

a single integral golf club head body which includes:

a ball striking face;

a perimeter weighting member extending in a direction rearwardly from the ball striking face and along at least a portion of a circumferential area of the golf club head body, wherein the perimeter member includes a protrusion which extends upwards from a sole portion of the perimeter weighting member that extends along a sole of the golf club head; and a cavity which is defined by the perimeter weighting member and ball striking face and at least a portion of the cavity is positioned between the perimeter weighting member and the ball striking face, wherein the protrusion of the perimeter weighting member has an inner surface facing into the cavity, wherein the second type of iron type golf chub head has a sole thickness that is greater than thicknesses of the sole of the first type of iron type golf club head, such that the cavity of the second type of iron type golf club head has a depth that is smaller than the cavity of the first type of iron type golf club head, and wherein the third type of iron type golf club head does not include a weighted insert between the perimeter weighting member and the ball striking face and along the sole of the golf club head.

34. A set of iron type golf clubs according to claim 33, wherein the set of golf clubs includes a 3 iron, a 4 iron, a 5 iron, a 6 iron and a 7 iron and the 3 iron, the 4 iron, the 5 iron, the 6 iron and the 7 iron each include the first type of golf club head.

35. A set of iron type golf clubs according to claim 34, wherein the set of golf clubs includes an 8 iron, a 9 iron and one or more wedges, and the 8 iron, the 9 iron and the one or more wedges each include the second type of golf club head.

* * * * *

UNITED STATES PATENT AND TRADEMARK OFFICE

CERTIFICATE OF CORRECTION

PATENT NO. : 8,632,416 B2
APPLICATION NO. : 13/215019
DATED : January 21, 2014
INVENTOR(S) : Michael E. Finn et al.

It is certified that error appears in the above-identified patent and that said Letters Patent is hereby corrected as shown below:

In the Claims

In Column 19, Claim 2, Line 7:
Please delete "dub" and insert --club--.

In Column 23, Claim 33, Line 32:
Please delete "head wherein" and insert --head, wherein--.

Signed and Sealed this
Twenty-second Day of April, 2014

Michelle K. Lee

Michelle K. Lee
*Deputy Director of the United States Patent and Trademark Office*